US007004126B2

(12) United States Patent
Nagano et al.

(10) Patent No.: US 7,004,126 B2
(45) Date of Patent: Feb. 28, 2006

(54) CAMSHAFT STRUCTURE

(75) Inventors: Shuji Nagano, Okazaki (JP); Satoshi Ando, Hamanatsu (JP); Masayuki Kamo, Okazaki (JP); Tetsushi Nagira, Toyota (JP)

(73) Assignee: Mitsubishi Jidoshi Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/833,545

(22) Filed: Apr. 28, 2004

(65) Prior Publication Data

US 2004/0211377 A1 Oct. 28, 2004

(30) Foreign Application Priority Data

Apr. 28, 2003 (JP) ..... 2003-123400

(51) Int. Cl.
*F01L 1/34* (2006.01)

(52) U.S. Cl. ..... 123/90.15; 123/90.17; 123/90.31; 123/90.6

(58) Field of Classification Search ..... 123/90.17, 123/90.15, 90.31, 90.16, 90.6
See application file for complete search history.

(56) References Cited

U.S. PATENT DOCUMENTS 5,850,812 A * 12/1998 Noguchi ..... 123/90.17
6,405,697 B1 * 6/2002 Mikame ..... 123/90.18

FOREIGN PATENT DOCUMENTS

JP 09-228812 (A) 9/1997

* cited by examiner

*Primary Examiner*—Thomas Denion
*Assistant Examiner*—Zelalem Eshete
(74) *Attorney, Agent, or Firm*—Rossi & Associates

(57) ABSTRACT

A structure for a camshaft includes a cam angle detecting element arranged to face a cam angle sensor and supported in a cantilever manner by a cam journal on the outer side of the cam journal. An extension journal between the cam journal and the cam angle detecting element is enlarged toward the cam journal such that the external diameter on the side of the cam journal may be larger than the external diameter on the side of the cam angle detecting element.

6 Claims, 3 Drawing Sheets

CAMSHAFT STRUCTURE

BACKGROUND OF THE INVENTION

1. Field of the Invention

The present invention relates to a structure for a camshaft, which can be applied to an intake camshaft, an exhaust camshaft or the like for an internal combustion engine.

2. Description of the Related Art

In the intake camshaft or exhaust camshaft for the internal combustion engine, journals are enhanced in strength or rigidity against a bending load or a torsional torque which acts on a cam or a cam lobe and against a torsional torque which acts on a variable valve timing mechanism. One of the means for enhancing is disclosed in JP-A-9-228812.

In a related art disclosed in JP-A-9-228812, a camshaft is provided with a variable valve timing mechanism is supported in a cantilever manner by a cam journal on the outer side of the cam journal. A plurality of cam journals are tapered such that their external diameters take the maximum diameter on the side of the variable valve timing mechanism and become smaller as being away from the variable valve timing mechanism.

SUMMARY OF THE INVENTION

In view of the related art, the invention has an object to provide a camshaft, which is provided with a cam angle sensor and in which a cam angle detecting element arranged to face the cam angle sensor is supported in a cantilever manner by a cam journal and on the outer side of the cam journal, so that the stress at the cantilever support portion by the cam journal of the cam angle detecting element is reduced to enhance the strength without entailing an increase of the weight.

In order to achieve the object, according to an aspect of the invention, there is provided a structure for a camshaft including a cam angle detecting element arranged to face a cam angle sensor and supported in a cantilever manner by a cam journal on the outer side of the cam journal, wherein an extension journal between the cam journal and the cam angle detecting element is enlarged toward the cam journal such that an external diameter on the side of the cam journal may be larger than an external diameter on the side of the cam angle detecting element. In the invention, the extension journal is preferably tapered.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

The invention will be described in detail in connection with its embodiment with reference to the accompanying drawings. However, the sizes, material, shapes, relative arrangements and so on of the components described in the embodiment are not intended to limit the scope of the invention thereto but are mere examples for the description, so long as specific explanations are not made.

Figure 1:
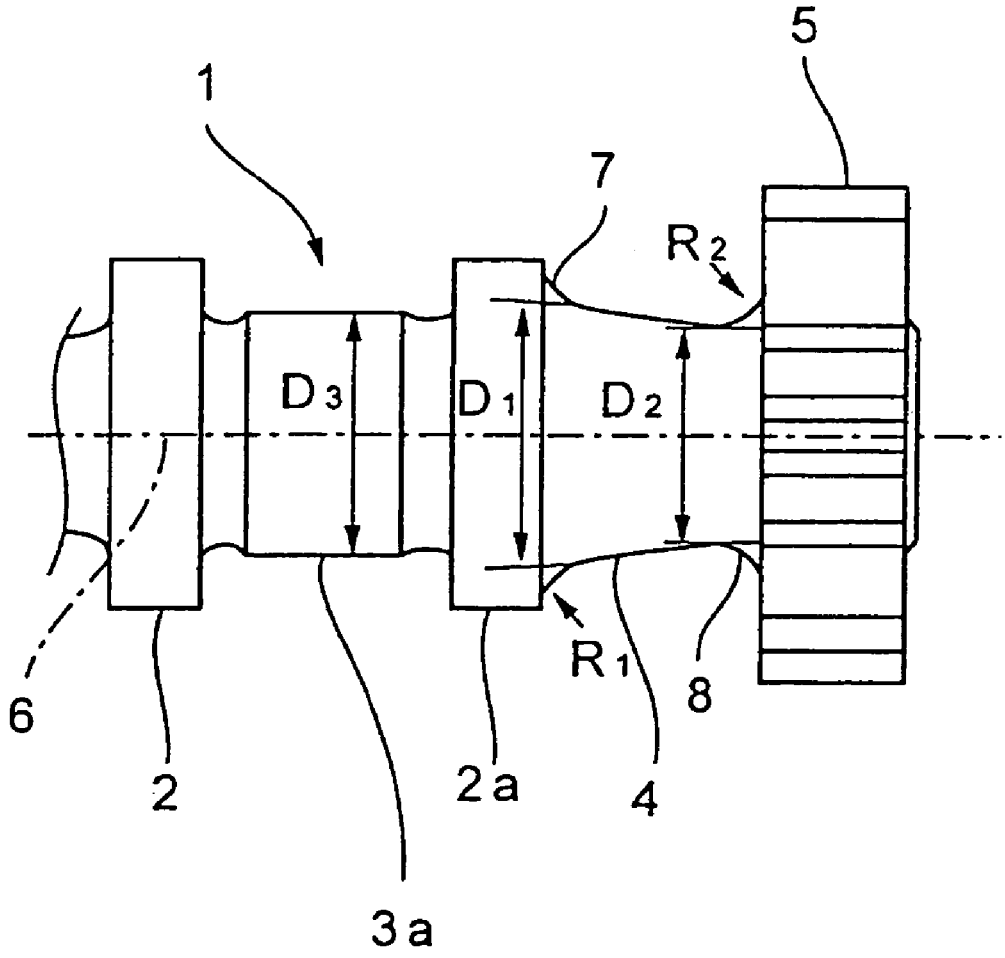
FIG. 1 is a side elevation of an essential portion near a cam angle detecting element of a camshaft according to an embodiment of the invention.
Figure 2:
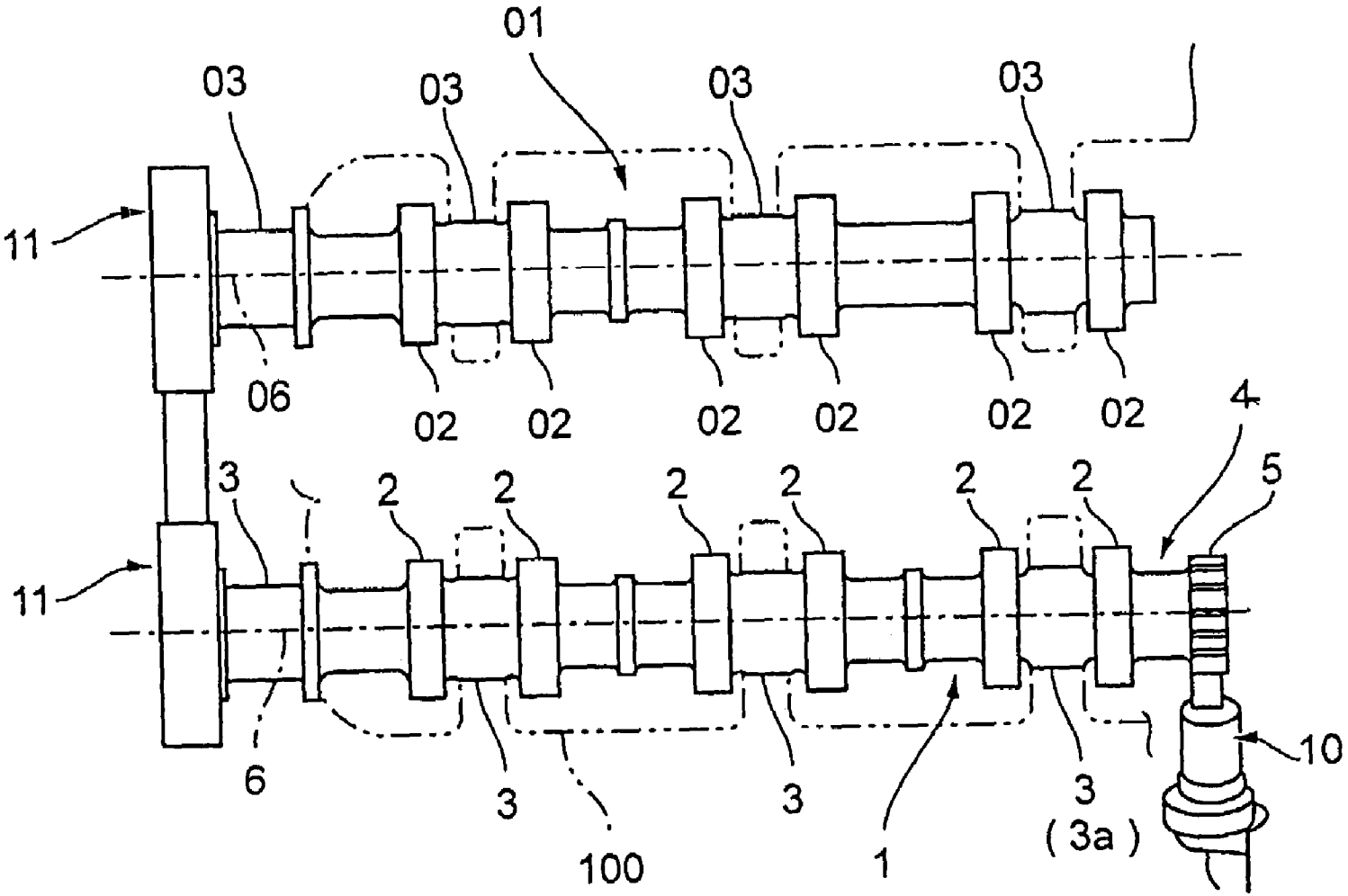
FIG. 2 is a top plan view of an intake camshaft and an exhaust camshaft.
Figure 3:
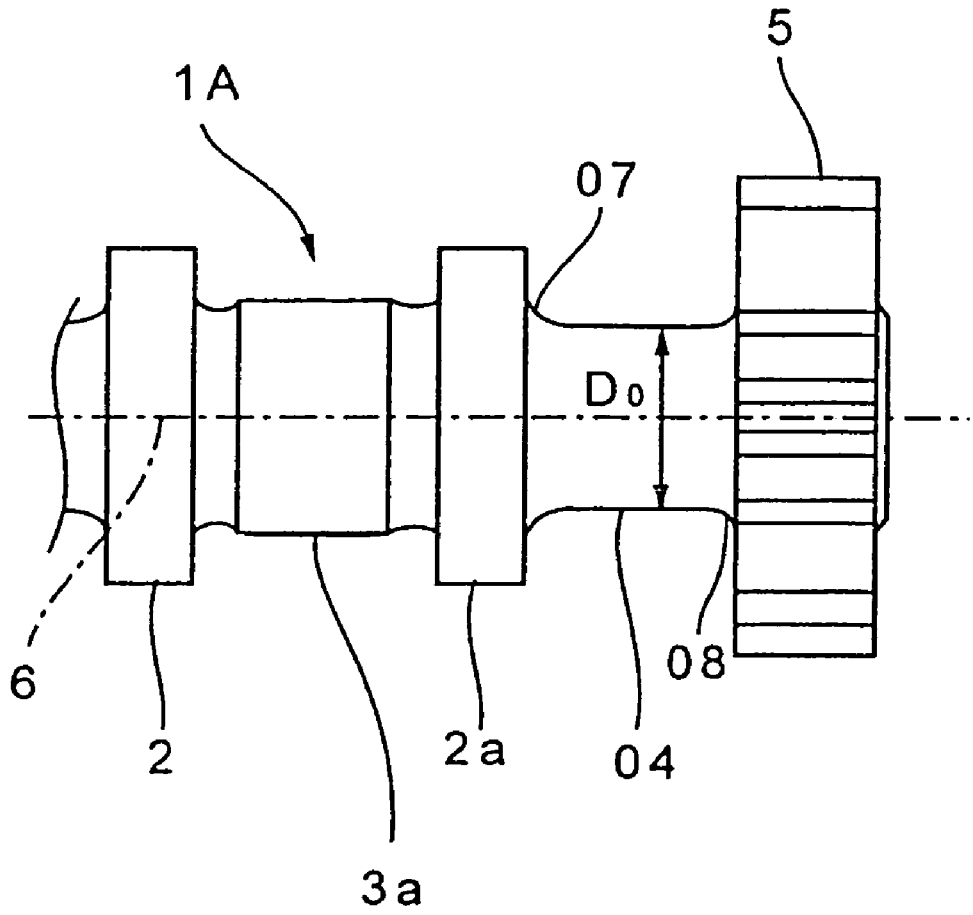
FIG. 3 is a diagram corresponding to FIG. 1 but shows a camshaft of the related art as a comparison example.

FIG. 1 is a side elevation showing an essential portion near a cam angle detecting element of a camshaft according to the embodiment of the invention, and FIG. 2 is a top plan view of an intake camshaft and an exhaust camshaft. FIG. 3 is a diagram corresponding to FIG. 1 but shows a camshaft of the related art as a comparison example.

In FIGS. 1 and 2, reference numeral 1 designates a camshaft. The embodiment of the invention indicates the intake camshaft 1 of FIG. 2.

In the camshaft 1, numeral 3 designates cam journals, which are formed at a plurality of axis direction of the camshaft 1. The camshaft 1 is supported at each of the cam journals 3 by the cam bearings (not-shown) fixed in a cylinder head 100, and is rotatably supported around the cam bearings 6. Numeral 2 designates cams (or intake cams), which are formed by two between each of the cam journals 3 for each of the cylinders.

Numeral 10 designates a cam angle sensor for detecting the cam angle of the intake camshaft 1. Numeral 11 designates a variable valve timing mechanism (which is well known in the art so that the description of its detailed structure is omitted). Numeral 5 designates a cam angle detecting element 5. The detecting element 5 is formed at the top end of an extension journal 4, which is protruded in a cantilever supporting form through an end side cam 2*a* from the cam journal 3*a* located at the end portion opposite to the variable valve timing mechanism 11.

The extension journal 4 is formed into a tapered journal enlarged toward the cam journal 3*a* such that an external diameter $D_1$ on the side of the cam journal 3*a* may be larger than an external diameter $D_2$ on the side of the cam angle detecting element 5. It is preferred that the external diameter $D_1$ of the enlarged portion is not larger than that of a base circle of the cam 2 but larger than an external diameter $D_3$ of the cam journal 3*a*, and that the enlarged portion merges smoothly into the base circle.

Moreover, the proximal portion 7 on the end side cam 2*a* which is the enlarged portion and a proximal portion 8 of the cam angle detecting element 5 which is the reduced portion merge smoothly into the cam 2*a* and the cam angle detecting element 5 respectively with radii $R_1$ and $R_2$, thereby the stress concentrations are suppressed at minimum.

In FIG. 2, numeral 01 designates an exhaust camshaft. Numeral 03 designates cam journals formed at a plurality of axis direction of the exhaust camshaft 01. This exhaust camshaft 01 is supported at each of the cam journals 03 by the cam bearings (not-shown) fixed in the cylinder head 100 and is rotatably supported around a cam axis 06. Numeral 02 designates exhaust cams, which are formed by two between each of the cam journals 03 for each of the cylinders. Numeral 11 designates the variable valve timing mechanism.

Here, the cam angle detecting element 5 may be formed at the exhaust camshaft 01 in place of the intake camshaft 1, and the cam angle sensor 10 may also be arranged to face the cam angle detecting element 5.

At the running time of an engine provided with the camshaft 1, the cam angle detecting element 5 may be resonated by the vibrations which are generated when the cam 2*a* on the end side pushes up the intake valve, because the extension journal 4 is configured with the cam angle detecting element 5 supported in a cantilever manner by the cam journal 3*a* on the end portion.

When the resonances occur, the proximal portion 7 of the extension journal 4 is subjected to the maximum repeated bending stress resulting from the resonances by the inertial force of the cam angle detecting element 5 which is formed with a large inertial weight at the distal end portion of the camshaft 1.

According to the embodiment, however, the extension journal 4 constructing the cantilever beam is formed into the tapered journal by making the external diameter $D_1$ at the proximal portion 7 on the side of the cam journal 3*a* larger than the external diameter $D_2$ on the side of the cam angle detecting element 5, so that the extension journal 4 has a structure similar to that of a beam having a substantially homogeneous strength.

As a result, the bending stresses of the extension journal 4 at each of the axial sections can be substantially equivalent and the bending stress is suppressed at the proximal portion 7 on the side of the cam journal 3*a* at which the stress concentration might be high.

In a camshaft 1A of the related art, as shown in FIG. 3 of the present invention, an extension journal 04 is configured to have an equal diameter. When the maximum repeated bending stress at a proximal portion 07 of the extension journal 04 on the side of the cam journal 3*a* is to be suppressed to the same level as that of the embodiment of the invention, an external diameter $D_0$ of the extension journal 04 has to be equalized to the external diameter $D_1$ of the embodiment, so that the extension journal 04 is diametrically enlarged as a whole, thereby the weight of the camshaft 1A is increased. In the embodiment, on the contrary, the extension journal 4 has a structure similar to that of the beam having the substantially homogeneous strength. Unlike the camshaft 1A of the related art, therefore, the maximum bending stress at the proximal portion 7 on the cam journal 3*a* can be reduced without entailing any increase of the weight of the camshaft 1.

According to the invention described above, in the camshaft in which the cam angle detecting element arranged to face the cam angle sensor is supported in a cantilever manner by the cam journal and on the outer side of the cam journal of the intake or exhaust camshaft of the engine, the extension journal supported in a cantilever manner by the cam journal can take a structure similar to that of the beam having a substantially homogeneous strength, and the bending stress at each of sections on axis direction is substantially equivalent. As a result, it is possible to suppress the bending stress at the proximal portion on the journal side, at which the stress might be seriously concentrated.

Accordingly, the maximum bending stress at the proximal portion on the journal side can be more reduced without entailing the increase of the weight of the camshaft than the camshaft of the related art that the extension journal has an equal diameter.

Moreover, similar effects can be obtained when the invention is applied to the camshaft, that the cam angle detecting element is supported in a cantilever manner by the cam journal on the end portion opposite to the variable valve timing mechanism.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A camshaft structure comprising:

a camshaft having a cam at a distal end of the camshaft;

a cam journal adjacent the cam;

an extension journal adjacent the cam, with the cam positioned between the cam journal and the extension journal; and a cam angle detecting element on the extension journal, wherein the extension journal nearer the cam has a larger diameter than the diameter nearer the cam angle detecting element and the diameter of the cam journal.

2. The camshaft structure according to claim 1, wherein the extension journal is tapered.

3. The camshaft structure according to claim 1, wherein the cam angle detecting element is configured to be positioned on an opposite side of a variable valve timing mechanism.

4. The cam shalt structure according to claim 1, wherein the cam angle detecting element is configured to face a cam angle sensor and configured to be supported in a cantilever manner by the cam journal on the outer side of the cam journal.

5. The cam shaft structure according to claim 2, wherein the cam angle detecting element is configured to face a cam angle sensor and configured to be supported in a cantilever manner by the cam journal on the outer side of the cam journal.

6. The cam shaft structure according to claim 3, wherein the cam angle detecting element is configured to face a cam angle sensor and configured to be supported in a cantilever manner by the cam journal on the outer side of the cam journal.

* * * * *